US008102275B2

(12) United States Patent
McGuire et al.

(10) Patent No.: US 8,102,275 B2
(45) Date of Patent: Jan. 24, 2012

(54) PACKAGE AND MERCHANDISING SYSTEM

(75) Inventors: Kenneth Stephen McGuire, Cincinnati, OH (US); John Patrick Goodall, Cincinnati, OH (US); Jerry Ray Stephens, Hamilton, OH (US); Michael G. Ferrari, Cincinnati, OH (US)

(73) Assignee: Procter & Gamble, Cincinnati, OH (US)

( * ) Notice: Subject to any disclaimer, the term of this patent is extended or adjusted under 35 U.S.C. 154(b) by 0 days.

(21) Appl. No.: 12/424,948

(22) Filed: Apr. 16, 2009

(65) Prior Publication Data

US 2009/0261114 A1 Oct. 22, 2009

Related U.S. Application Data

(63) Continuation of application No. 12/172,421, filed on Jul. 14, 2008, and a continuation-in-part of application No. 11/824,704, filed on Jul. 2, 2007.

(51) Int. Cl.
*G08B 5/00* (2006.01)

(52) U.S. Cl. ..... 340/815.4; 361/670

(58) Field of Classification Search ..... 340/815.4; 361/679, 670; 362/161
See application file for complete search history.

(56) References Cited

U.S. PATENT DOCUMENTS

| | | | | |
|---|---|---|---|---|
| 4,135,024 | A | 1/1979 | Callahan et al. | |
| 4,610,743 | A | 9/1986 | Salmeen | |
| 4,797,795 | A | 1/1989 | Callahan | |
| 4,931,224 | A | 6/1990 | Holzner, Sr. | |
| 5,063,698 | A | 11/1991 | Johnson et al. | |
| 5,173,351 | A | 12/1992 | Ruppel et al. | |
| 5,409,572 | A | 4/1995 | Kershaw et al. | |
| 5,573,830 | A | 11/1996 | Schulz | |
| 5,597,639 | A | 1/1997 | Schulz | |
| 5,620,776 | A | 4/1997 | Schulz | |
| 5,620,779 | A | 4/1997 | Levy et al. | |
| 5,874,156 | A | 2/1999 | Schulz | |
| 5,903,710 | A | 5/1999 | Wefler et al. | |
| 6,129,815 | A | 10/2000 | Larson et al. | |
| 6,241,359 | B1 * | 6/2001 | Lin | 362/96 |
| 6,260,703 | B1 | 7/2001 | Morton | |
| 6,302,559 | B1 | 10/2001 | Warren | |
| 6,348,766 | B1 | 2/2002 | Ohishi et al. | |
| 6,361,885 | B1 | 3/2002 | Chou | |
| 6,441,921 | B1 | 8/2002 | Soscia | |
| 6,468,392 | B2 | 10/2002 | Oriarian et al. | |
| 6,740,429 | B2 | 5/2004 | Aziz et al. | |
| 6,759,146 | B2 | 7/2004 | Aziz et al. | |

(Continued)

FOREIGN PATENT DOCUMENTS

EP 1312466 A1 5/2003

(Continued)

*Primary Examiner* — Shirley Lu
(74) *Attorney, Agent, or Firm* — David K Mattheis; Kelly L McDow; Kim W Zerby

(57) ABSTRACT

A sensory interactable packaging assembly having a base and a container. The base has a power supply. The container may contain a consumer product. The container is removably attachable to the base. The container has an outer surface and a sensory interactable element disposed on the outer surface and a control system having an output. The control system is s in electrical communication with the sensory interactable element and the sensory interactable element is responsive to the output of the control system when the container is proximate to the base and the control system is in electrical communication with the power supply.

7 Claims, 11 Drawing Sheets

U.S. PATENT DOCUMENTS

| | | | | |
|---|---|---|---|---|
| 6,767,654 | B2 | 7/2004 | Tamao et al. | |
| 6,897,623 | B2 | 5/2005 | Yoneda et al. | |
| 6,924,781 | B1 | 8/2005 | Gelbman | |
| 6,980,196 | B1 | 12/2005 | Turner et al. | |
| 6,987,787 | B1 | 1/2006 | Mick | |
| 7,023,109 | B2 | 4/2006 | Amano | |
| 7,212,175 | B1 | 5/2007 | Magee et al. | |
| 7,227,313 | B2 | 6/2007 | Huiberts et al. | |
| 7,227,652 | B2 | 6/2007 | Cronch et al. | |
| 7,233,831 | B2 | 6/2007 | Blackwell | |
| 7,262,559 | B2 | 8/2007 | Tripathi et al. | |
| 7,317,303 | B1 | 1/2008 | DeVilbiss | |
| 7,345,301 | B2 | 3/2008 | Gerhard et al. | |
| 7,419,072 | B1 | 9/2008 | Vanella | |
| 2005/0140498 | A1 | 6/2005 | Bastian | |
| 2005/0190072 | A1 | 9/2005 | Brown et al. | |
| 2005/0237153 | A1 | 10/2005 | Chen | |
| 2006/0109644 | A1 | 5/2006 | Saucier, Sr. et al. | |
| 2007/0069883 | A1 | 3/2007 | Collier | |
| 2007/0165366 | A1* | 7/2007 | Sokola | 361/679 |
| 2008/0094825 | A1* | 4/2008 | Silver | 362/161 |
| 2009/0008275 | A1 | 1/2009 | Ferrari | |

FOREIGN PATENT DOCUMENTS

| | | | |
|---|---|---|---|
| EP | 1321287 | A2 | 6/2003 |
| EP | 1736951 | | 12/2006 |
| WO | WO03031170 | A1 | 4/2003 |
| WO | WO 2009/004591 | A | 1/2009 |

* cited by examiner

PACKAGE AND MERCHANDISING SYSTEM

CROSS REFERENCE TO RELATED APPLICATION

This application is a continuation-in-part of U.S. application Ser. No. 11/824,704, filed Jul. 2, 2007, and a continuation of U.S. application Ser. No. 12/172,421, filed Jul. 14, 2008.

FIELD OF THE INVENTION

A product package used for merchandising the product and a system incorporating the package. Particularly, a package and merchandising system for interactive shopping environments.

BACKGROUND OF THE INVENTION

The volume of different products offered in any product category challenges marketers to find ways of obtaining the attention of potential purchasers. Labels, colors, shapes and other package attributes are well known tools for passively attracting the attention of a shopper. What is desired is an active system for drawing the attention of a shopper to the offerings of the marketer.

SUMMARY OF THE INVENTION

In one aspect, a package comprises a package wall, a display element integral to the package wall and visible from the exterior of the package. The package further comprises a power receiving element operably connected to the display element. The display element changes a characteristic according to a first characteristic change profile received from the power receiving element.

In another aspect, a product merchandising system comprises a sensor disposed to detect the presence of a target. The sensor provides an output upon detecting the target. The system also includes a package comprising a package wall, a display element integral to the package wall and visible from the exterior of the package, and a power receiving element integral to the package and operably connected to the display element. The system includes a power distribution element, and a controller. The controller is operably connected to the sensor and to the power distribution element. The controller receives the output of the sensor as an input and provides an output profile to the power distribution element. The power distribution element receives the output profile from the controller and provides a power profile to the power receiving element.

DETAILED DESCRIPTION OF THE INVENTION

Figure 1:
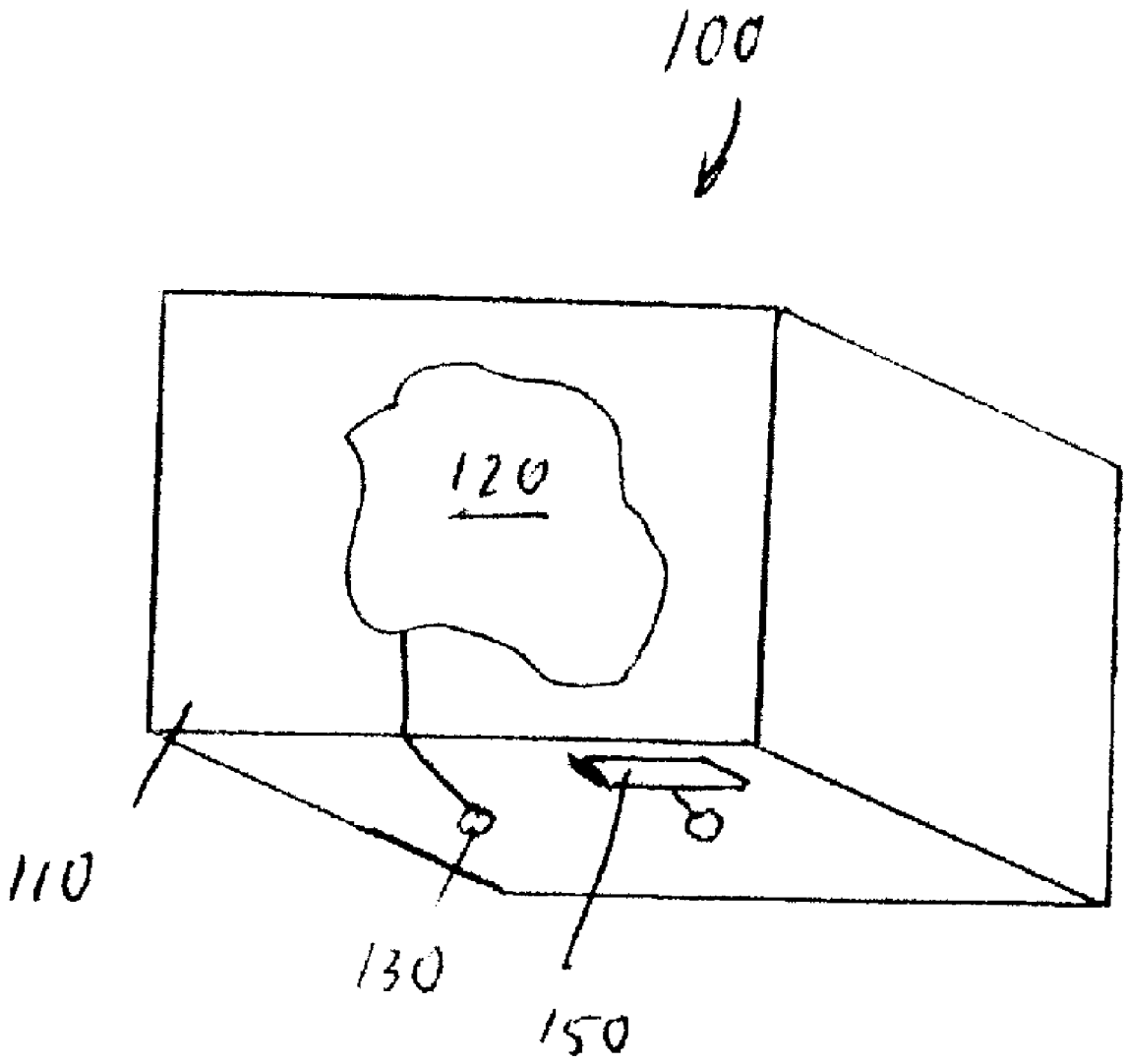
FIG. 1 provides a schematic perspective view of a package according to one embodiment of the invention.

"Base", as used herein, refers to any module or unit that may act as a support surface and/or foundation for a container of the present invention. In one nonlimiting embodiment, a base may further comprise components or parts that may activate, provide power to and/or manage additional components associated with a packaging assembly, such as a sensory interactive element. In another nonlimiting embodiment, a container may fit into, onto, or be supported by, the base. In yet another nonlimiting embodiment, a container comprises a controller.

"Consumer", as used herein, refers to any person or entity that may purchase, make a decision to purchase, or contemplate purchasing a product. In one nonlimiting embodiment, the consumer may be the end user of a product.

"Container", as used herein, refers to any covering material, box, holder, vessel, envelope, carton, overwrap, outer covering, or any other embodiment in which at least a portion of a product can be placed for shipping, transport, storage and/or sale. A container may be any shape or size that is required for the desired function or product. In a nonlimiting example, a container may be cubic, cylindrical, or pyramidal. A container may be made of any material that is required for the desired function. Exemplary nonlimiting materials include cardboard, plastic, glass, metal, paper, wood, and combinations thereof.

"Control system", as used herein, refers to a device or set of devices that are capable of managing, commanding, directing or regulating the behavior of other devices or systems via an output. For example, a control system may be utilized to activate and/or deactivate one or more sensory interactable elements. Without wishing to be limited by theory, it is thought that there are two common classes of control systems, with many variations and combinations: logic or sequential controls, and feedback or linear controls. An automatic sequential control system may trigger a series of mechanical actuators in the correct sequence to perform a designated task. In the case of linear feedback systems, a control loop, including sensors, control algorithms and actuators, may be arranged in such a fashion as to try to regulate a variable to a set point or reference value. Exemplary control systems are described in U.S. Pat. Nos. 4,797,795; 7,233,831 and 6,987,787. Exemplary devices that a control system may control are a sensory interactable element and/or power supply.

In one nonlimiting embodiment, a control system may be integrated into a container. For example, a control system may be printed on the surface of the container itself using any printed electronics technology that is known to one of skill in the art. In another exemplary embodiment, a control system may be provided into the body of the container by a chip or circuit board. Alternatively, a control system may be disposed onto the inner surface of a container. One of skill in the art will appreciate that a control system may be provided such the control system is in electrical communication with the sensory activatable element and/or the power source by induction or direct connection. In another nonlimiting embodiment, a control system may be integrated into a unit separate from the base or the container. For example, a control system and/or power supply may be integrated into a shelving unit or other display unit at a retail location so that the retailer may have an active product package or container on display without necessarily having a base unit on the same display. In the exemplified embodiment, supra, the retail shelving unit may comprise both the power supply and the control system are capable of interaction with the sensory element on the container to provide the packaging assembly with the appropriate electronic signals to function.

"Packaging assembly", as used herein, refers to a group of components that may be used alone or in combination to provide a single packaging unit. In one nonlimiting embodiment, a packaging assembly comprises a container, base, control system, product, and sensory interactable element.

"Power supply", as used herein, refers to any device or equipment that provides a source of energy to another device or piece of equipment. One of skill in the art may appreciate that a power supply may provide electrical energy or output, or another form of energy to a load. In one nonlimiting embodiment, a power supply generates an electric field which may be used to cause the electrons in a material to move into an excited state. The excited electrons may then drop out of the excited state and, in doing so, may release energy in the form of light. In some nonlimiting embodiments, a power supply may also describe a switched-mode power supply, linear regulator, rectifier, inverter, batteries, chemical fuel cells, solar cells, and combinations thereof. Exemplary power supplies are described in U.S. Pat. Nos. 7,262,559; 7,023,109; 7,227,652; 6,897,623; 6,348,766 and 7,317,303.

"Product", as used herein, refers to any object, material or substance that is intended for use by a consumer. In some nonlimiting embodiments, a product may be selected from the group consisting of wipes, napkins, facial tissues, bathroom tissue, paper towels, baby care products, feminine care products, household care products, personal care products, and combinations thereof.

"Sensory interactable element", as used herein, refers to any mechanism, piece of equipment, apparatus, device, or the like that provides at least partial stimulation to any one or more of the senses—including the sense of smell, sight, touch, taste, and/or sound. In one nonlimiting embodiment, a sensory interactable element may be illuminatable (e.g., provides a light when activated). In another nonlimiting embodiment, a sensory interactable element may be auditorily activatable (e.g., provides a sound or noise when activated). In another nonlimiting embodiment, a sensory interactable element may be odoriferously activatable (e.g., provides a smell or odor when activated).

"Illuminatable sensory interactable element" or "illuminatable device" or "illuminatable element", as used herein, refers to an element or device that may be disposed on a substrate emit or radiate light over any range of the visible spectrum. Exemplary illuminatable sensory interactable elements include electroluminescent elements, LEDs (including organic LEDs), incandescent elements, chemiluminescent elements, cathodoluminescent elements, triboluminescent elements, photoluminescent elements, and phosphorescent elements, and combinations thereof. In one nonlimiting embodiment of the present invention, an illuminatable sensory interactable element comprises an electroluminescent element. Illuminatable sensory interactable elements may be configured to form letters, words, shapes, animations and combinations thereof. One of skill in the art may appreciate that an electroluminescent element may provide the benefits of relatively low energy consumption, relatively little generation of thermal energy, capable of being printed onto a substrate, may provide easily changeable and relatively free-flowing illuminatable areas, and may be powered by a power supply that provides an electric field or from a power supply that is directly coupled to the control system. One of skill in the art will appreciate that other illuminatable elements such as organic LEDs or inorganic LEDs, may also be powered in a similar manner. Exemplary electroluminescent element devices are described in U.S. Pat. Nos. 6,361,885, 6,759,146, 7,345,301, 7,227,313, 6,740,429 and 6,767,654. An electroluminescent device may be any color or shape that is suitable for the desired application.

As illustrated in FIG. 1, a package 100 comprises a package wall 110. The package 100 may comprise a plurality of package walls 110. The package may be formed from any packaging materials as these are known in the art. Exemplary packaging material include: paperboard and corrugated paperboard, metal foils, polymeric materials, wood, metallocene films and composite material formed from combinations thereof. The package wall 110 includes a display element 120. Exemplary display elements 120 include electroluminescent elements organic light emitting diodes, thermo chromic elements and combinations of these. The display element may comprise elements printed upon the package wall 110 or upon a label affixed to the package wall 110. The disposition of display element 120 makes it visible from the exterior of the package 100. The display element may comprise a portion of an exterior surface of the package 100, or the nature of the package 100 may permit the viewing of the display element 120 disposed upon an interior surface of the package via a transparent or semi-transparent exterior surface of the package 100. A transparent or semi-transparent surface may comprise all or only a portion of one or more exterior surfaces of the package 100.

The display element 120 may comprise an indicia or a portion of an indicia. The display element may serve as an outline or penumbra of an indicia or a portion of an indicia. The indicia may comprise text or graphics and may relate to the package contents of to other items. The indicia may be printed upon the package, molded into the wall of the package, or otherwise formed into the package wall as is known in the art. The indicia may comprise branding information associated with the package contents or associated with a co-marketing effort. The indicia may be associated with a product attribute or with a product performance attribute. Exemplary product attributes include textual descriptors such as new, better, stronger, whiter, more concentrated, fat free, caffeine free, less calories, and flavor indicators. Exemplary product performance attributes include textual descriptors, cleans, brightens, whitens, colors, instant, long lasting, and permanent. Graphical illustrations of the above delineated descriptors are also considered indicia.

Display element 120 may comprise all or part of any of the indicia described above. Display element 120 may comprise a penumbra adjacent to or near the described indicia to outline or highlight the indicia.

The package 100 further comprises a power receiving element 130. Power receiving element 130 is operably connected to the display element. The display element 120 changes a characteristic according to a power profile received from the power receiving element 130. The power profile produces a characteristic change in the display element 120 and may be considered a characteristic change profile.

The package 100 may comprise multiple display elements 120 and multiple power receiving elements 130. A single power receiving element 130 may provide a characteristic change profile to one or more of the display elements 120.

Multiple respective power profiles may be provided to the package 100 via the respective power receiving elements 130. The receipt of respective characteristic change profiles may enable the package display elements to change characteristics according to a predetermined pattern or according to a randomized pattern due to the provision of a sequence of power profiles.

The characteristic change of the display element 120 may comprise a change in the luminosity, color, or both, of the display element 120. In one embodiment, at least a portion of display element 120 changes from a first color to a second color according to the characteristic change profile.

In one embodiment the package 100 comprises an integral power source (not shown). The power source (not shown) provides power to the power receiving element 130 and thereby to the display element 120. Solar panels and chemical battery cells are exemplary integral power elements (not shown).

In one embodiment the package 100 comprises a control element 150. The control element 150 is operably connected between the power receiving element 130 and the display element 120. The control element 150 comprises a control circuit which may alter a characteristic change profile received from the power receiving element 130. In one embodiment the control element 150 provides a characteristic change profile to the display element 120 in response to power received from the power receiving element 130. In this embodiment the power received may be represented by an idealized step function wherein the power is intended to either be on or off. This received power is subsequently modified by the control element to provide a characteristic modifying profile to the display element 120. Exemplary profiles include, sinusoidal, saw-tooth, a segmented step function to alternate between providing and denying power transfer and other control signal patterns as are known in the art.

In one embodiment the control element 150 provides a plurality of profiles to a plurality of display elements 120 to orchestrate a series of characteristic changes in the package. The package 100 may comprise a portion of a merchandising system 1000. The system 1000 may further comprise a sensor 200 to provide a signal according to the presence of a shopper in a predetermined location relative to a package display area. Exemplary sensors 200 include, retro-reflective and through beam electromagnetic sensors, induction loop sensors to detect the presence of a metal shopping cart, load cell based sensors to detect the weight of a shopper at a particular location and other sensors as are known in the art.

In one nonlimiting embodiment, a plurality of illuminatable sensory interactable elements may be used in combination. For example, the plurality of illuminatable elements may be coordinated to illuminate sequentially, in unison, intermittently, or randomly to form an animation. For example, a plurality of illuminatable elements may be disposed on a package or container to simulate a number of lights dispersed on a wreath or tree. Alternatively, a number of illuminatable elements may be disposed on a package or container to simulate an animated light board or marquee. In another nonlimiting embodiment, an illuminatable element may be used to provide a light source on a package or container. For example, an illuminatable element may be disposed on, or near, an opening of a package or container to assist a consumer who may be attempting to access the product in the dark, similar to a night light. Such an embodiment may be contemplated to be particularly useful for a box of facial tissues or for a box of wipes.

"Odoriferously interactable", as used herein, refers to the quality of an element or device that may emit a scent upon activation. Exemplary odoriferously activatable devices are described in U.S. Pat. Nos. 5,903,710 and 4,931,224.

"Auditorily interactable", as used herein, refers to the quality of an element or device that may emit a sound upon activation. Exemplary auditorily activatable devices are described in U.S. Pat. Nos. 6,441,921, 5,063,698, and 6,260,703.

Without wishing to be limited by theory, it is thought that consumers may prefer to have a more than one sensory interactable feature on the package or container. For example, a container may have a plurality of electroluminescent devices configured to simulate a rainbow and the container may further comprise an auditorily interactable element that plays Arlen and Harburg's "Over the Rainbow." Alternatively, a container may have a plurality of electroluminescent devices configured to simulate apples on an apple tree and the package may further comprise an odoriferously interactable element that releases a simulated apple pie scent upon use. An example of a device combining an odoriferously interactable element with an illuminatable sensory interactable element is described in U.S. Pat. No. 6,302,559.

Electronic Devices

In a first nonlimiting embodiment, an electronic device such as a sensory interactable element and/or control system may be provided by using printing technology to dispose conductive, printed electronic circuits onto the outer, or inner, surface of a container, base, or any other desired unit. For example, a sensory activatable element and/or control system may be printed onto a substrate, such as a card, which may be adhesively or mechanically affixed onto a container, base, or other unit.

Without wishing to be limited by theory, an electronic device may be printed by applying conductive inks through screen printing, gravure printing, ink jet printing, flexographic printing, or any other printing method familiar to those skilled in the printing art, onto the surface of the container. In one nonlimiting embodiment, a plurality of different printing methods may be used to apply the ink to the surface being printed on. It has been found that a non-trivial amount of space and money may be saved by using printed electronic circuits instead of using individually manufactured components such as resistors, light bulbs, capacitors, and the like. An exemplary printed electronic circuit is described in U.S. Pat. No. 6,980,196.

Base

A base of the present invention may act as a foundation or support surface/structure for a container of the present invention. In one nonlimiting embodiment, the base may comprise an orifice or other opening with which to provide mating engagement with the container. In another nonlimiting embodiment, a container may simply come into contact with the base. In yet another nonlimiting embodiment, components of the base may be in electrical communication with components of the container without having the base and container come into direct physical contact.

A base may provide additional functionality to the overall product package assembly. In one nonlimiting embodiment, a base may contain elements or devices which may provide a source of power (e.g., a power supply, electric field, etc.) to the packaging assembly in order to activate and/or control sensory interactable elements and/or a controller. In one embodiment, the base may comprise any necessary circuitry and/or componentry to accept power from a wall outlet. In another nonlimiting embodiment, the base may contain any necessary circuitry and/or componentry to accept power from a battery or from a photocell or other device.

In another nonlimiting embodiment, the base may comprise a control unit. For example, the base may have a control system integrated therein where the control system comprises an output which may control some additional feature (such as a sensory activatable element) that may be incorporated in the base, on the container, electrically coupled to the container, or in some other part of the assembly, such as a container.

While the embodiments described supra indicate that the base may act as a foundation or support unit for a package of the assembly, it is contemplated that the base does not necessarily have to directly support the container (e.g., fit underneath the container), but may operate with the assembly in any configuration with, or while proximate to, the package or container. An exemplary nonlimiting embodiment is a base comprising a device capable of providing an electric field and/or a magnetic field. An exemplary container may comprise a sensory interactable element, such as an electroluminescent device, which is activated by an electric field proximate thereto. In another nonlimiting embodiment, an exemplary container comprises a sensory interactable element, power supply, and control system which may be activated when placed proximate to a magnet, the magnet providing a magnetic field which then completes a circuit between the sensory interactable element, power supply, and control system.

Container

The container may be designed such that it is removably attachable to the base. Nonlimiting examples of a container according to the present invention may include: a box, holder, vessel, envelope, carton, overwrap, outer covering, and combinations thereof that may be used to contain, store, secure, stock, and combinations thereof any product that the consumer may desire. In one nonlimiting embodiment, the product may be selected from the group consisting of paper products, feminine care products, wipes, paper towel products, bathroom tissue products, napkins, baby care products, facial tissue products, and combinations thereof. One of skill in the art will appreciate that any product, and not only the ones listed, may be used in the present invention packaging assembly. A container may comprise one or more openings for a consumer to access a product stored therein.

In another nonlimiting embodiment, the container further comprises additional elements of the packaging assembly. For example, a container may comprise a power supply, control system, sensory interactable element, and combinations thereof. In one nonlimiting embodiment, the container may comprise the circuitry and/or wiring and/or componentry to accept power from a power supply. In another example, the container may contain the circuitry and/or wiring and/or componentry to provide electrical communication between a control system and a sensory interactable element.

In another nonlimiting embodiment, the container may comprise a control system. In the exemplary embodiment, the container may have a control system integrated therein wherein the control system comprises an output. The control system may control some additional feature, such as a sensory activatable element, that may be incorporated in the container, or in some other part of the packaging assembly, such as a base. The control system may be adapted to receive electrical, or some other, power from a power supply.

A container may further comprise a sensory interactable element as described supra. In one nonlimiting embodiment, the sensory interactable element is illuminatable as described supra. In another nonlimiting embodiment, a plurality of illuminatable sensory interactable elements may be used in combination. For example, all of the illuminatable elements may illuminate in unison, or may illuminate intermittently to form an animated image. Such an animated image may be controlled using a control system as described infra. In one nonlimiting embodiment, a control system may control a plurality of sensory interactable elements. For example, a plurality of illuminatable elements may be disposed on a package or container to simulate a number of lights on a wreath or tree. Alternatively, a number of illuminatable elements may be disposed on a package or container to simulate an animated light board or marquee. In another nonlimiting embodiment, an illuminatable element may be used to provide a light source on a package or container. For example, an illuminatable element may be disposed on, or near, an opening of a package or container to act as a "night light" and assist a consumer who may be attempting to access the product in the dark. Such an embodiment is contemplated to be particularly useful for a box of facial tissues or for a box of wipes.

In one nonlimiting embodiment, the sensory interactable element may be integrated directly into the container. For example, the sensory interactable element may be adhered directly to the surface of the container. In another nonlimiting embodiment, the sensory interactable element may be printed onto the surface of the container (i.e., using an electroluminescent ink) as described supra.

The container may be of any shape that is suitable for the desired application. For example, the container may have a cylindrical shape wherein base is circular or oblong. Alternatively, the base may be any polygon, such as a square, hexagon, octagon, triangle, and combinations thereof.

Control System

In one nonlimiting embodiment the purpose of the control system may be to convert power from the power supply into an appropriate form for providing electrical communication to a sensory interactable element. For example, an embodiment in which the sensory interactable element comprises an electroluminescent material may require an alternating current to illuminate. In this example, the control system may convert the power from the power supply to an alternating current. Such control systems are known to those of skill in the electrical art. In another nonlimiting embodiment, it may be preferred to provide electrical communication between the control system and the sensory interactable element via induction. One of skill in the art will appreciate that electrical communication provided via induction may preclude the use of a direct mechanical interconnection between the control system and the sensory interactable element. In this case, the control system would have to convert the power from the power supply into an electromagnetic field to interact with a parasitic inductor, such as a sensorial element.

The control system can also provide the function of "sequencing" the sensorial elements to, for example, create an illuminated animation on the package. In this case, the power from the power supply may be converted to the appropriate form and then be turned "on" and "off" in some desired timed sequence to provide the animated effect. Other sensorial effects such as sound and smell could also be controlled by the control system.

In one nonlimiting embodiment, the control system may be provided by printing conductive inks onto a container or some other substrate in a form that complements the sensory interactable elements. For example, the control system may be printed on the outer surface of a container such that the overall ink pattern (both conductive and non-conductive ink) may take the appearance of a wreath. A plurality of illuminatable sensory interactable elements, such as electroluminescent devices, may be also printed to provide the appearance of a number of lights on the wreath. Thus, the overall image on the outer surface of the container is one of a wreath with lights, wherein at least portions of the printed wreath actually function as the control system which may control the sequence and/or timing of the illumination of the electroluminescent devices.

Power Supply

Without wishing to be limited by theory, it is thought that a power supply may be used to provide the control system and sensory interactable elements with power for them to operate. It is thought that the control system may receive power from the power supply in any number of ways. One example of a method of transferring power from the power supply to the control system is through a direct, conductive contact. This may be in the form of a plug and receptacle if, for example, the system requires that the power supply and control system be assembled or disassembled for use. In an alternative exemplary embodiment, the power from the power supply may be transferred to the control system by inductive means, such as using electrical or magnetic fields, thereby eliminating the requirement of directly connecting the two.

In a nonlimiting embodiment of the present invention packaging assembly, a power supply may provide power either directly or inductively. In one embodiment, a power supply may be directly electrically connected with the control system. In another nonlimiting embodiment, a power supply generates an electric field and/or a magnetic field which inductively activates the control system and/or sensory interactable element. A power supply may be selected from the group consisting of: a direct wall outlet, batteries, photocells, solar cells, fuel cells, linear power supplies, switching power supplies, or any other power source known to those skilled in the art, and combinations thereof. In a specific, but nonlimiting, embodiment, power may supplied by one or more battery which may be integrated into the base of the present invention packaging assembly.

Sensory Interactable Consumer Product Package

Figure 1A:
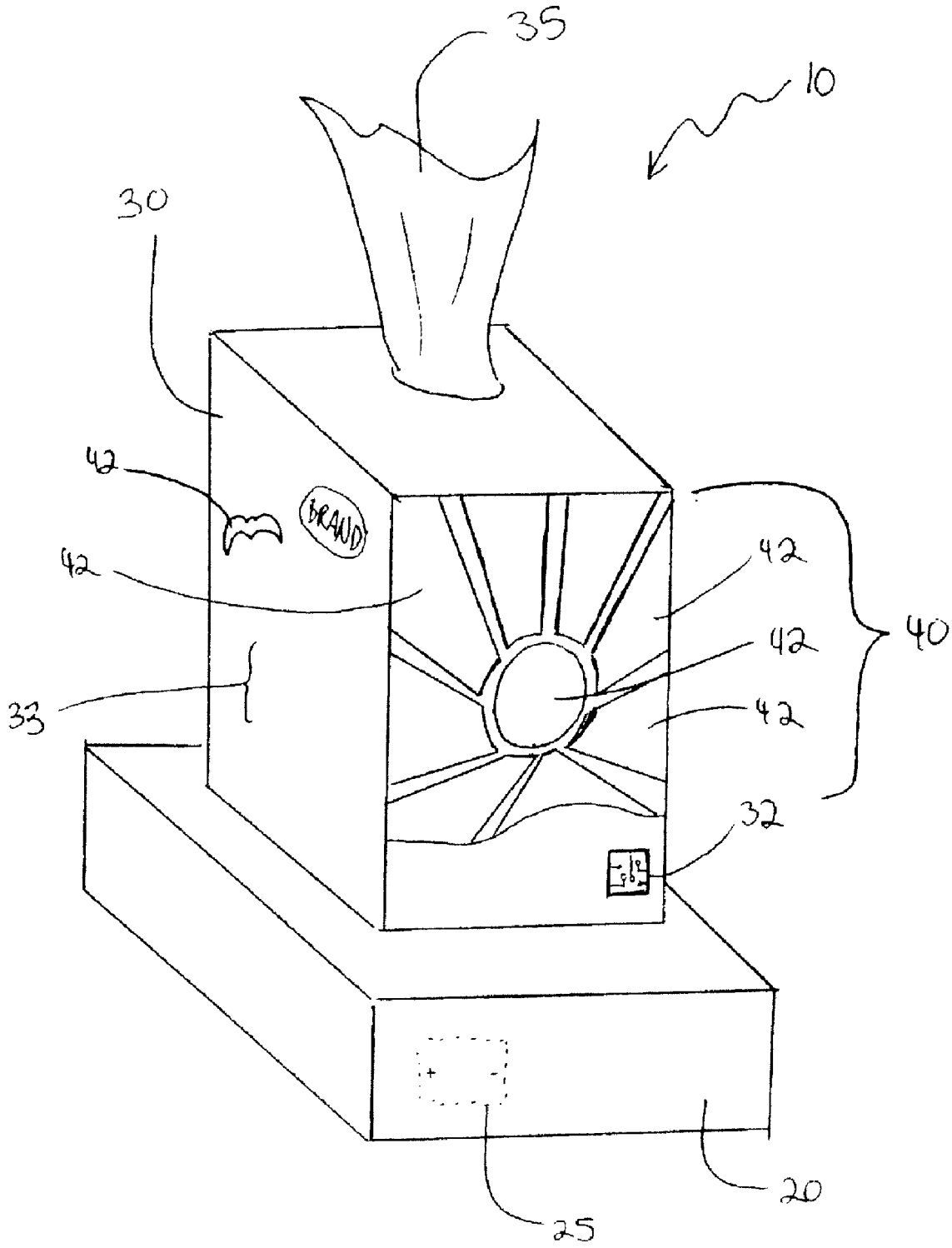
FIG. 1A is an exemplary embodiment of a packaging assembly according to the present invention.

FIG. 1A provides an exemplary nonlimiting embodiment of a packaging assembly having a sensory interactable element ("assembly") 10 of the present invention. In the nonlimiting exemplary embodiment, the assembly 10 comprises a base 20, a container 30, a control system 32, and a power supply 25. The container 30 may be designed such that it is removably attachable to the base. The assembly 10 further comprises an animation 40 disposed on the outer surface 33 of the container 30. In the exemplary embodiment, the animation 40 further comprises a plurality of individual sensory interactable elements ("elements") 42 which are individually or collectively illuminatable. The assembly optionally comprises a plurality of product 35.

The elements 42 may be configured in any arrangement that may be suitable for the desired application. In the exemplary embodiment, the elements 42 are configured to simulate rays of sunlight. Similarly, the control system 32 may be provided as a discrete unit in, or on, the container 30 as exemplified in FIG. 1A. The base 20 may comprise a power supply 25 which provides an electric or magnetic field. The field can then be inductively coupled to the control system 32 disposed upon the outer surface 33 of the container 30. In the exemplary embodiment, the power supply 25 and control system 32 may be in electrical communication when the base 20 and container 30 are in direct physical contact or when the base 20 is proximate to, but not necessarily in direct physical contact with, the container 30.

Figure 1B:
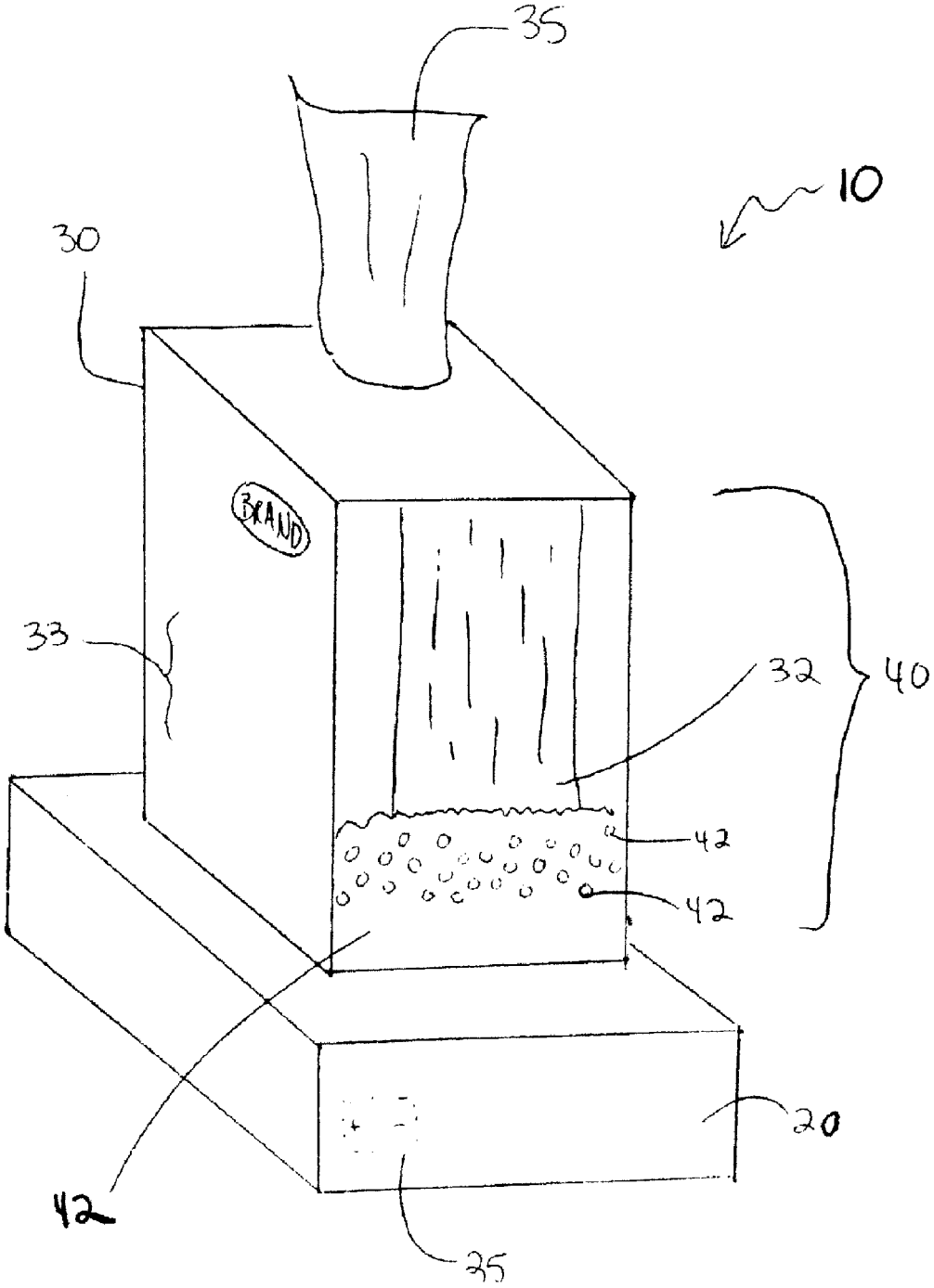
FIG. 1B is another exemplary embodiment of a packaging assembly according to the present invention.

The control system further comprises an output which can cause the elements 42 to be illuminated, or otherwise activated. The control system 32 may be programmed to cause the individual elements 42 to illuminate in a coordinated fashion so as to create an animated-appearing image. For example, in the exemplary embodiment, the control system 32 may be programmed so as to cause the elements 42 to illuminate from the center of the pattern outwards—thus creating an effect in the overall animation 40 that the sun is radiating light outwards. An alternative exemplary embodiment is shown in FIG. 1B wherein the control system 32 may be provided as at least a portion of an element of the animation 40. In the exemplary embodiment the control system 32 is printed onto the outer surface 33 of the container 30 to simulate a waterfall, and the elements 42 simulate the spray at the bottom of the waterfall. As is exemplified in the embodiment of FIG. 1B, the elements 42 do not necessarily have to be the same shape or color.

Figure 2:
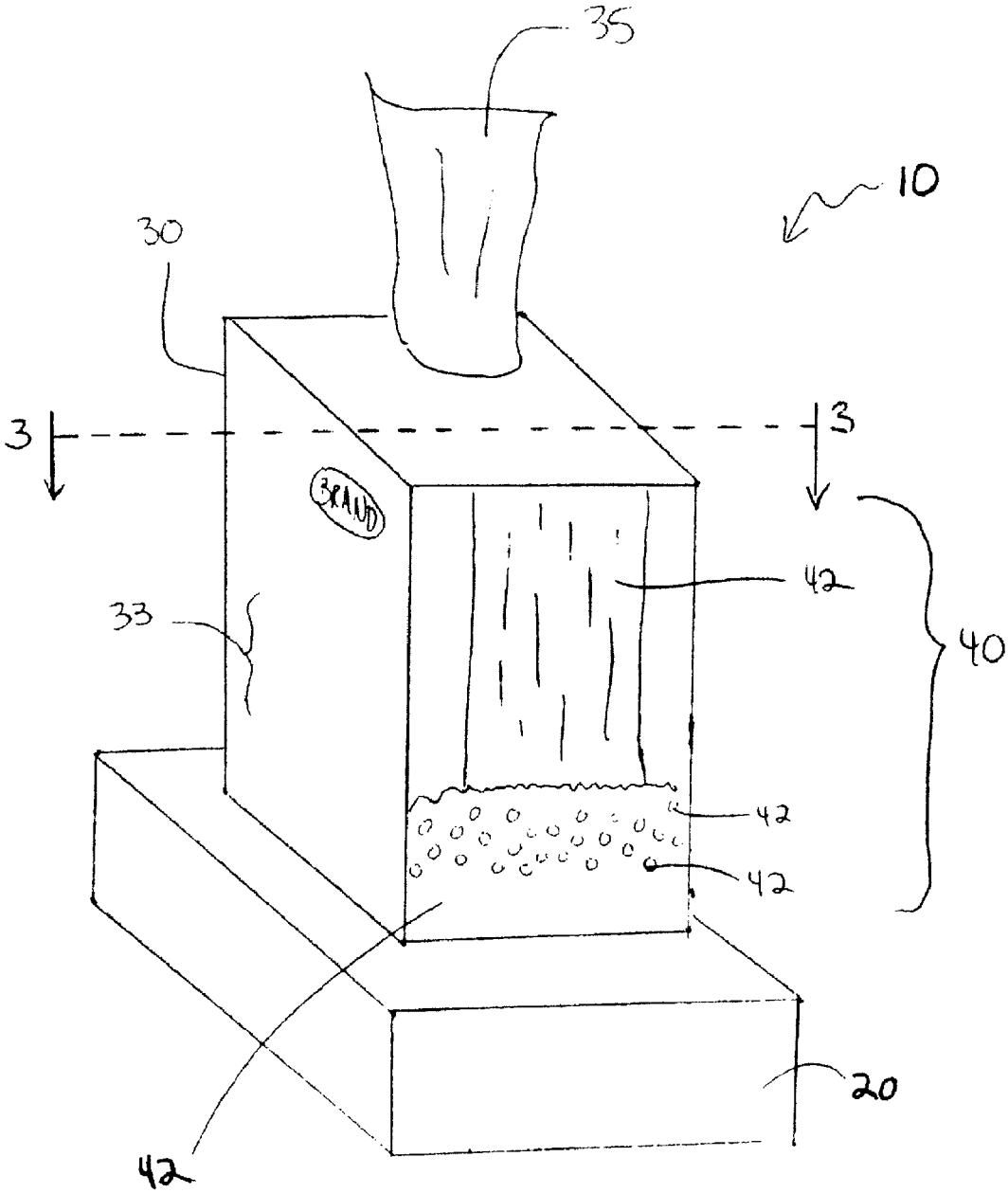
FIG. 2 is yet another exemplary embodiment of a packaging assembly according to the present invention.

FIG. 2 is a nonlimiting exemplary embodiment of an assembly 10. In the exemplary embodiment, the assembly 10 comprises a base 20 and a container 30. The assembly 10 further comprises an animation 40 formed from a plurality of elements 42 and the container 30 may be provided with a plurality of consumer product 35. The packaging assembly 10 further comprises a control system 32 (FIG. 4), and a power supply 25 (FIG. 4) which are integrated into the bodies of the container and base, respectively.

Figure 3:
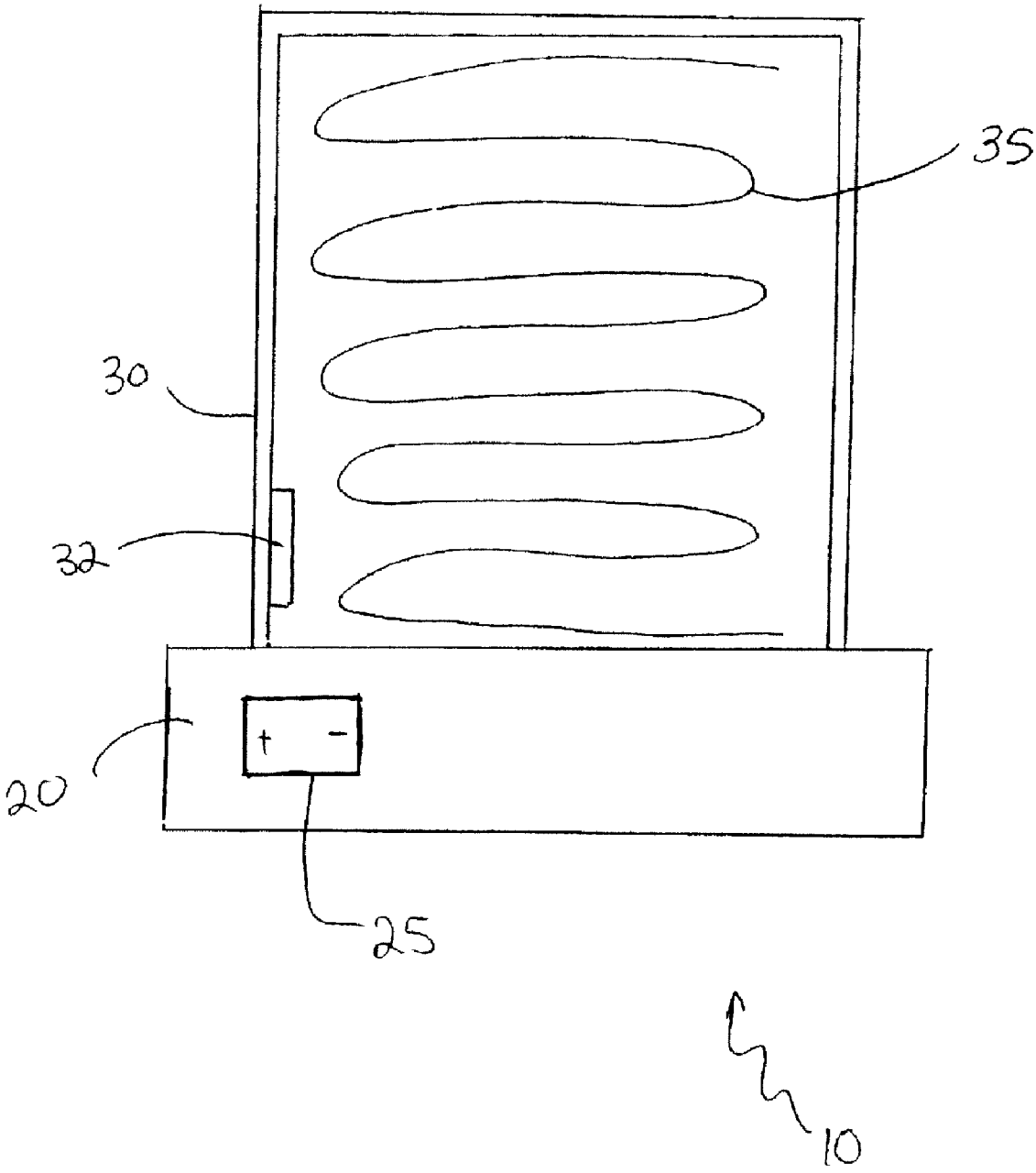
FIG. 3 is a cross-sectional view of the embodiment of FIG. 2 taken along line 3-3.

FIG. 3 is a cross-sectional view of the embodiment of FIG. 2 taken along the line 3-3. The control system 32 and power supply 32 are shown as being integrated into the inner surface of the container 30 and the body of the base 20, respectively.

Figure 4:
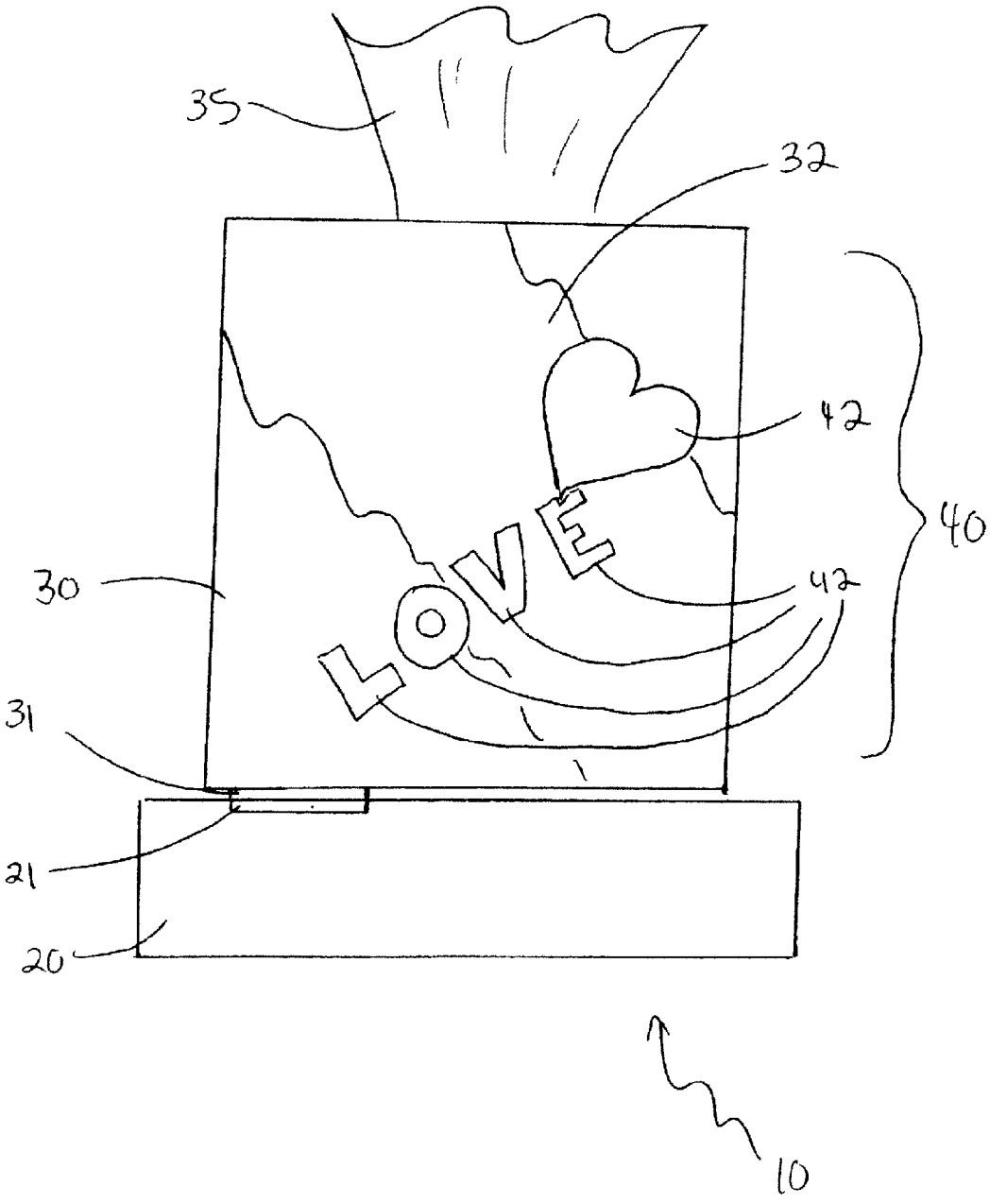
FIG. 4 is an additional exemplary embodiment of a packaging assembly according to the present invention.

FIG. 4 shows another embodiment of the assembly 10 wherein the container 30 further comprises a first conductive unit 31 in electrical communication with the power supply 25, control system 32 and/or sensory interactable elements 42. In the exemplary embodiment, the base 20 may further comprise a second conductive unit 21 in electrical communication with the control system 32, power supply 25 and/or elements 42. In this embodiment, a circuit is completed when the first and second conductive units 31, 21 are brought into physical contact, thus providing power to the animation 40.

Figure 5:
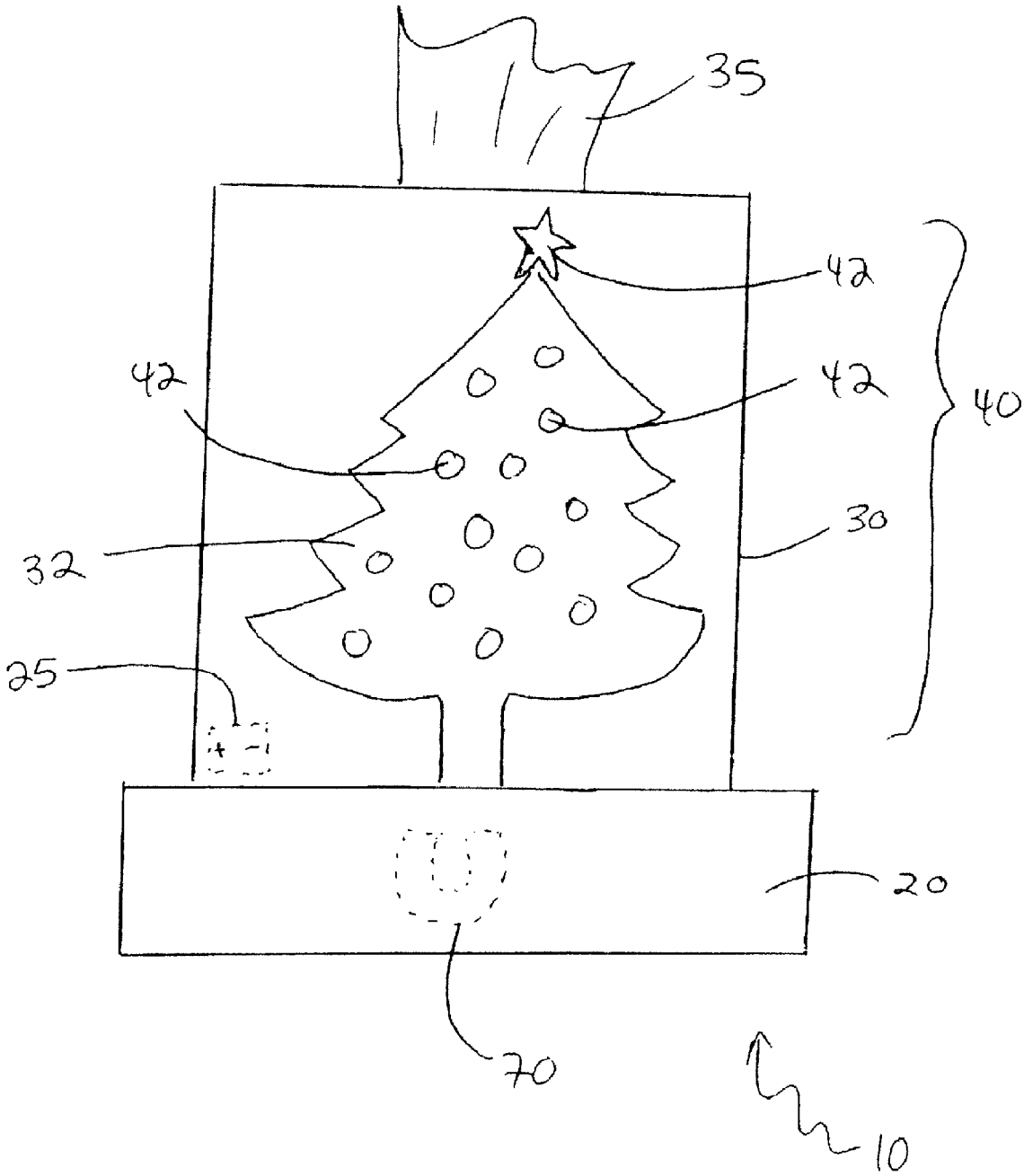
FIG. 5 is yet another exemplary embodiment of a packaging assembly according to the present invention.

FIG. 5 shows yet another embodiment of the assembly 10 wherein the container 30 comprises plurality of elements 42, a power supply 25, and control system 32, and optionally product 35. The elements form an animation 40. The base 20 comprises a magnet 70 wherein the magnet 70 completes an electrical circuit between the power supply 25 and control system 32 when the container 30 is proximate to the base 20. Upon completion of the circuit, the elements 42 may be activated.

Figure 6:
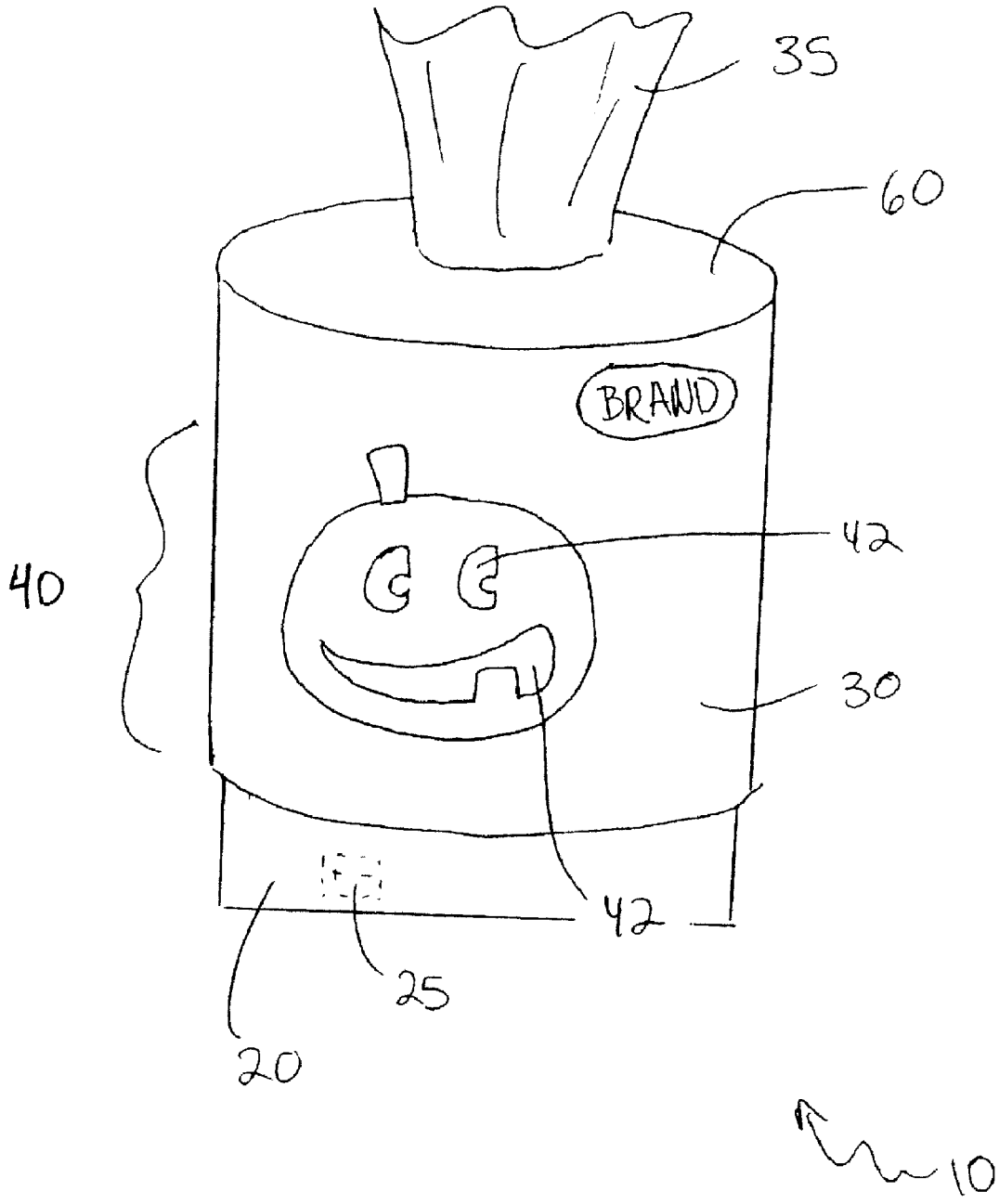
FIG. 6 is yet still another exemplary embodiment of a packaging assembly according to the present invention.

FIG. 6 shows yet another embodiment of the assembly 10 wherein the base 60 of the container 30 is oblong.

Figure 7:
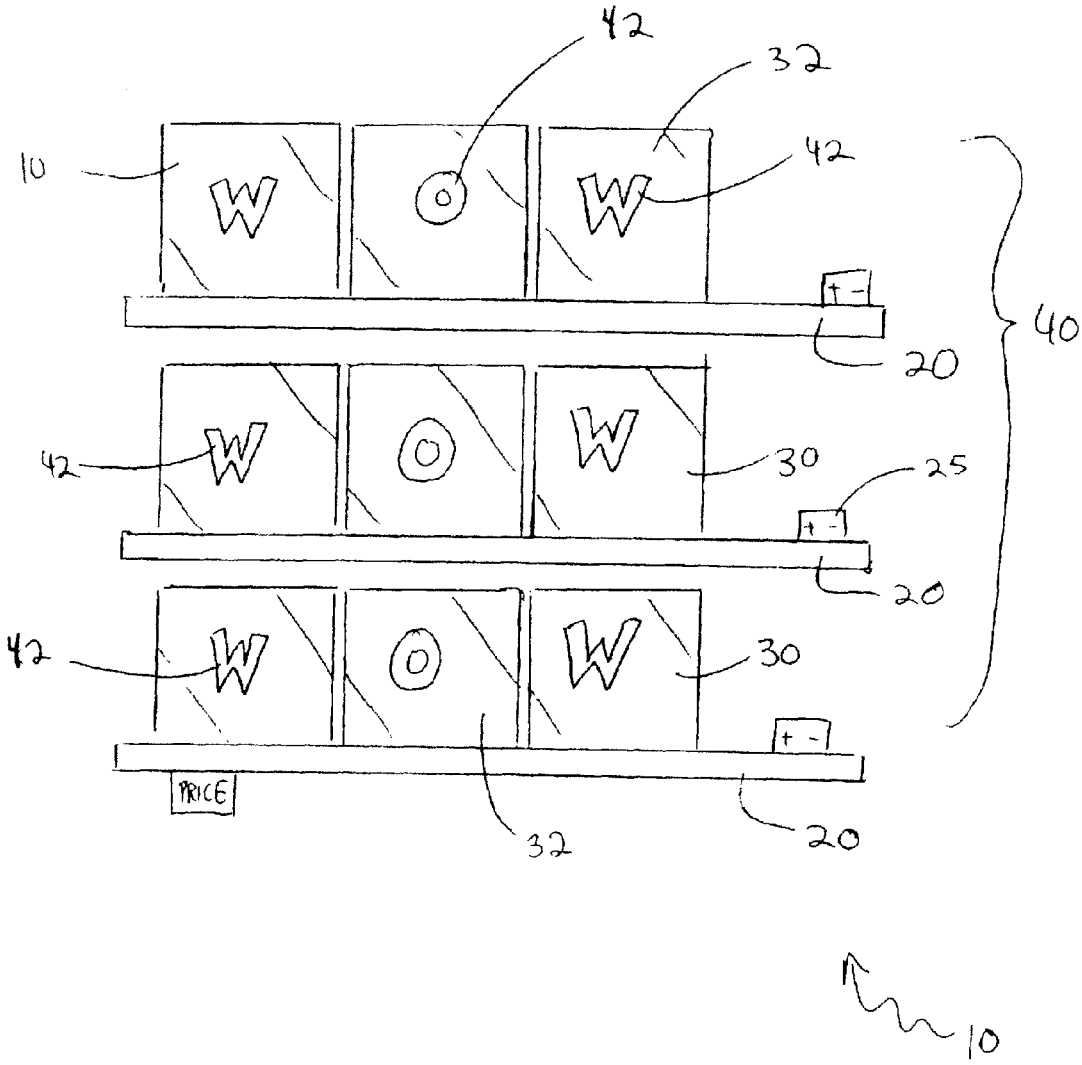
FIG. 7 is an exemplary embodiment of a retail shelf that may be used as a packaging assembly according to the present invention.

FIG. 7 shows an embodiment of the present invention assembly 10 wherein the base 20 is a retail product shelf. In the exemplary embodiment a power supply 25 may be integrated into a retail product shelf which may serve as a base 20. The containers 30 may then be active while on display in a retail location. Without wishing to be limited by theory, it is thought that an advantage of using a retail product shelf as a base is that replacement containers 30 may be sold separately from a unit containing an individual base 20 (as shown in FIGS. 1A-6), but wherein the replacement containers 30 may still demonstrate their functionality to the consumers while in a retail location. Further, a plurality of individual containers 30 may be configured in a retail location to form a larger animation 40.

Figure 8:
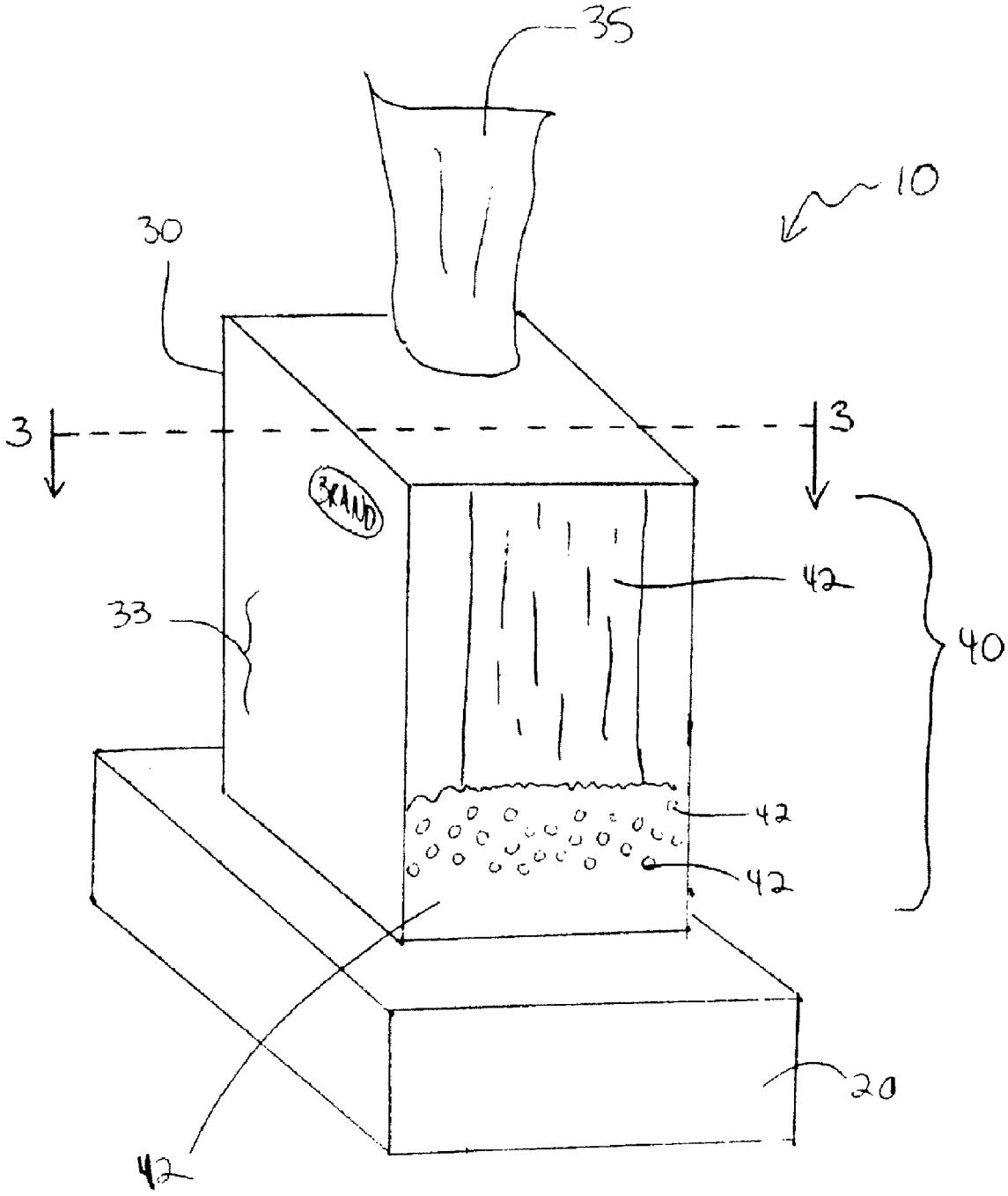
FIG. 8 is another exemplary embodiment of a packaging assembly according to the present invention.

FIG. 8 is a nonlimiting exemplary embodiment of an assembly 10 which comprises a base 20 and a container 30. The assembly 10 further comprises an animation 40 formed from a plurality of elements 42 and the container 30 may be provided with a plurality of consumer product 35. The packaging assembly 10 further comprises a control system 32

(FIG. 9) and a power supply 25 (FIG. 9) which are integrated into the body of the base. In an alternative embodiment, the power supply 25 and/or control system 32 may be disposed on any suitable surface of, or area within, the base.

Figure 9:
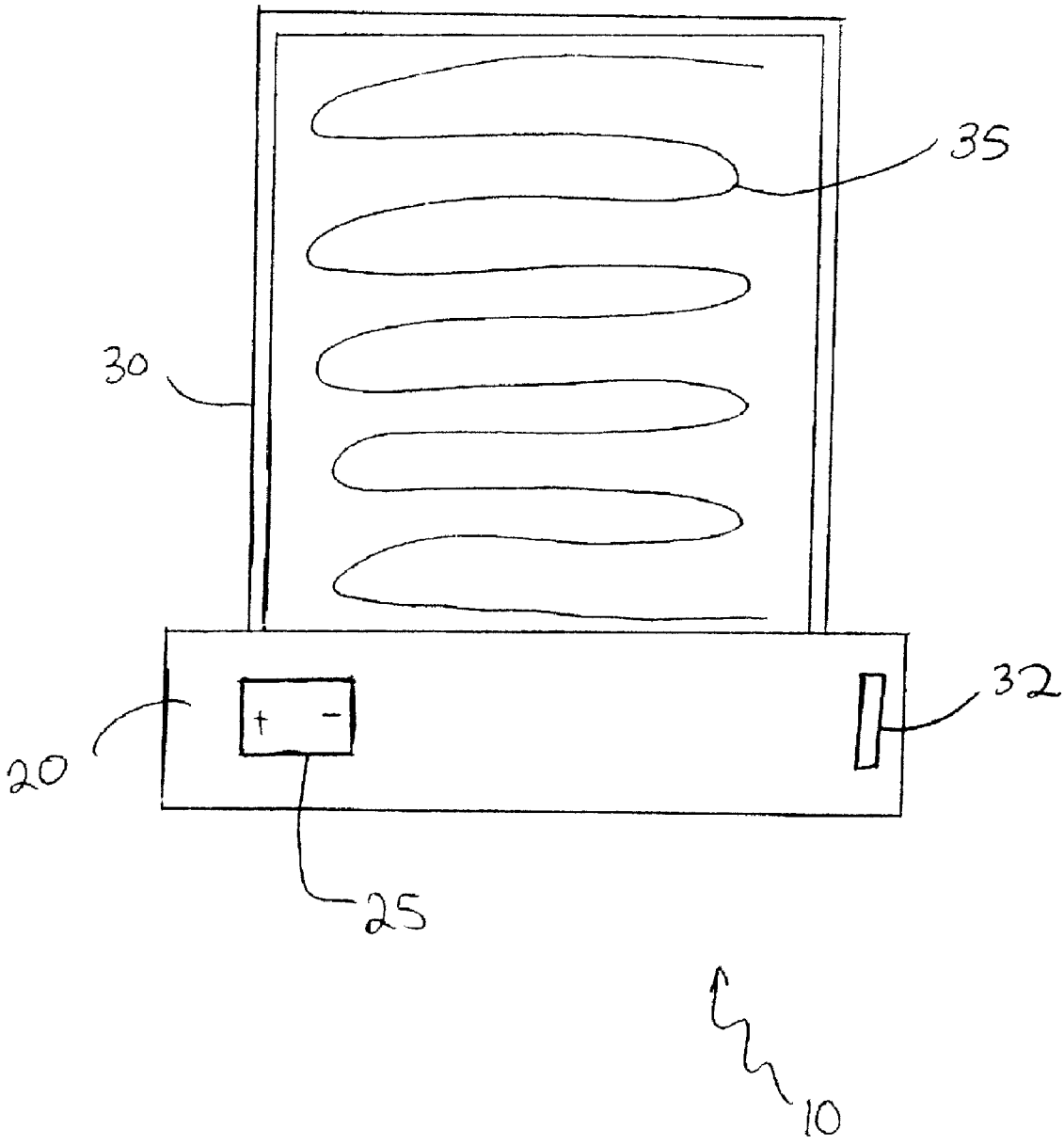
FIG. 9 is a cross-sectional view of the embodiment of FIG. 8 taken along line 9-9.

FIG. 9 is a cross-sectional view of the embodiment of FIG. 2 taken along the line 3-3. The control system 32 and power supply 32 are shown as being integrated into the inner surface of the container 30 and the body of the base 20, respectively.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A sensory interactable packaging assembly comprising:

(i) a base comprising a power supply;

(ii) a container for containing a consumer product, wherein the container is removably attachable to the base, wherein the container comprises:

1. an outer surface; and,
2. a plurality of sensory interactable elements disposed on the outer surface cooperatively combined to form an image; and (iii) a control system having an output, wherein the control system is integral with the container, wherein the control system is in electrical communication with the sensory interactable element; and wherein the sensory interactable element is responsive to the output of the control system when the container is in mating engagement with the base and the control system is in electrical communication with the power supply, wherein the container further comprises a first conductive unit in electrical communication with the power supply, the base further comprises a second conductive unit in electrical communication to the control system, and wherein the first conductive unit and second conductive unit are in contact when the container is in mating engagement with the base.

2. The sensory interactable packaging assembly of claim 1 wherein the sensory interactable element is selected from the group consisting of: illuminatable elements, odoriferously interactable elements, auditorily activatable elements, and combinations thereof.

3. The sensory interactable packaging assembly of claim 2 wherein the sensory interactable element is an illuminatable element, and the illuminatable element is selected from the group consisting of: electroluminescent elements, organic LEDs, LEDs, incandescent elements, chemiluminescent elements, cathodoluminescent elements, triboluminescent elements, photoluminescent elements, and phosphorescent elements, and combinations thereof.

4. The sensory interactable packaging assembly of claim 3 wherein the illuminatable element is an electroluminescent element.

5. The sensory interactable packaging assembly of claim 1 wherein the sensory interactable element is responsive to contacting engagement of the first conductive unit and the second conductive unit.

6. The sensory interactable packaging assembly of claim 1 wherein the image is an animation.

7. The sensory interactable packaging assembly according to claim 1 wherein the base comprises a magnet.

* * * * *